United States Patent [19]

Martin et al.

[11] Patent Number: 4,666,622

[45] Date of Patent: May 19, 1987

[54] STABLE THICKENED LOW PH LIQUID BLEACHING COMPOSITIONS CONTAINING INORGANIC PEROXY COMPOUNDS

[75] Inventors: Alexander Martin, Helsby; Colin Overton, Bromborough; David Machin, Great Sutton, all of Great Britain

[73] Assignee: Lever Brothers Company, New York, N.Y.

[21] Appl. No.: 811,921

[22] Filed: Dec. 20, 1985

[30] Foreign Application Priority Data

Jan. 3, 1985 [GB] United Kingdom ..... 8500116

[51] Int. Cl.[4] ..... C11D 1/62; C11D 3/06; C11D 3/39

[52] U.S. Cl. ..... 252/99; 252/95; 252/100; 252/101; 252/102; 252/186.43; 252/528; 252/547; 252/DIG. 14

[58] Field of Search ..... 252/95, 99, 100, 101, 252/102, DIG. 14, 186.27, 186.28, 186.32, 186.43, 547

[56] References Cited

U.S. PATENT DOCUMENTS

| | | | |
|---|---|---|---|
| 3,194,768 | 7/1965 | Lindner et al. | 252/100 X |
| 3,684,722 | 8/1972 | Hynam et al. | 252/98 |
| 3,852,210 | 12/1974 | Krezanoski | 252/95 |
| 3,956,159 | 5/1976 | Jones | 252/104 |
| 3,976,318 | 9/1976 | Tokiwa et al. | 252/95 X |
| 4,129,517 | 12/1978 | Eggensperger et al. | 252/102 X |
| 4,166,794 | 9/1979 | Grey | 252/8.8 |
| 4,238,192 | 12/1980 | Kandathil | 8/111 |
| 4,414,127 | 11/1983 | Fu | 252/95 |
| 4,470,919 | 9/1984 | Goffinet et al. | 252/102 |

FOREIGN PATENT DOCUMENTS

| | | |
|---|---|---|
| 2305532 | 11/1976 | France . |
| 7218 | 1/1980 | Japan . |
| 2073233 | 10/1983 | United Kingdom . |

*Primary Examiner*—Prince E. Willis

*Attorney, Agent, or Firm*—Milton L. Honig; James J. Farrell

[57] ABSTRACT

The present invention pertains to an aqueous stable thickened low-pH bleaching composition comprising (a) a thickening surfactant selected from the group consisting of amine-oxides, amines and cationic detergent actives, (b) a cold-water soluble inorganic peroxy compound, (c) a strong acid, and (d) optionally a bleach-compatible electrolyte salt.

9 Claims, No Drawings

STABLE THICKENED LOW PH LIQUID BLEACHING COMPOSITIONS CONTAINING INORGANIC PEROXY COMPOUNDS

The present invention relates to bleach-containing cleaning compositions and, in particular, to thickened liquid cleaning compositions which are based on an aqueous solution of a bleaching agent selected from the group of inorganic peroxy acids or salts thereof.

Inorganic peroxy acids such as peroxymonosulphuric acid or peroxymonophosphoric acid, are well known for their oxidative properties, and have been proposed for a number of specialized uses, such as shrink-proofing, textile bleaching, denture cleaning etc.

In U.S. Pat. No. 3,556,711 aqueous bleaching compositions are disclosed wherein peroxymonosulphate is used in combination with an aliphatic monocarboxylic acid salt. The compositions which are useful in textile bleaching, are non-thickened and have a pH of 5 to 10.

In the British patent application No. 2,022,641 liquid bleaching and softening compositions are described including a water-soluble peroxy bleaching agent, which comprises at least 50% of hydrogen peroxide and, optionally, an auxiliary bleaching agent which may be selected from the group of peroxycarbonates, peroxyborates, peroxymonosulphates and peroxymonophosphates etc. The compositions are non-thickened and adjusted to pH of 4 to 5.

In the U.S. Pat. No. 3,149,078 liquid abrasive cleaning compositions are described for which the optional inclusion of peroxymonosulphate is mentioned.

To our knowledge, up till now the inclusion of inorganic peroxy acids in thickened low-pH liquid products has not been disclosed.

Although in the British Pat. No. 2,073,233 thickened low-pH hard-surface cleaning compositions have been proposed, the formulation of stable products including a bleaching agent has proven quite troublesome.

Thickened bleach-containing hard surface cleaning products are widely used in the hygienic cleaning of lavatory pans, urinals, drains, waste pipes and the like. It is essential that such products are thickened to viscosities which enable optimal performance even on non-horizontal surfaces. By far the majority of these products are based on a hypochlorite bleaching agent and, accordingly, such compositions are highly alkaline in order to obtain the necessary stability of the hypochlorite bleaching agent. Due to the high alkalinity, precipitation of lime scale or water scale from toilet flush water can be caused.

Acidic products based on hydrogen peroxide solutions are poor bleaches and have grossly inferior germicidal properties when compared to the alkaline hypochlorite-based products.

It is now an object of the present invention to provide an effectively bleaching hard surface cleaning composition which is based on acidic bleach. It is a further object to provide such compositions which are thickened to viscosities which enable them to adhere to non-horizontal surfaces for sufficient time and to perform their bleaching action before draining off. It is a still further object of the present invention to provide such compositions which are physically and chemically stable for prolonged periods of time.

It has now been found that by using a thickening system based on a thickening surfactant selected from the group of amine oxides, amines and cationic detergent actives, and strong acids, physically and chemically stable liquid bleaching compositions can be formulated comprising an inorganic water-soluble peroxy compound.

Accordingly, the present invention provides aqueous stable thickened low-pH bleaching compositions which comprise a thickening surfactant selected from the group of amine oxides, amines and cationic detergent actives, a cold-water soluble inorganic peroxy compound, a strong acid, and optionally, a bleach-compatible electrolyte salt.

The inorganic peroxy compounds for use in the compositions of the present invention must be cold-water soluble and provide effective bleaching action at lower pH vaues, in particular at pH values below 4. Suitable examples are the group VA and VIA peroxides, such as peroxymonophosphoric acid, peroxydiphosphoric acid, peroxymonosulphuric acid, peroxydisulphuric acid and the alkali metal and ammonium salts thereof, in particular tetrapotassium peroxydiphosphate, tetrasodium pyrophosphate bis (peroxyhydrate), diammonium peroxydisulphate, dipotassium peroxydisulphate, disodium peroxydisulphate and the triple salt oxone peroxymonosulphate.

Peroxymonosulphuric acid and the alkali metal and ammonium salts thereof are preferred. Peroxymonosulphuric acid is commercially available in aqueous solution as Caro's acid prepared by addition of concentrated hydrogen peroxide to concentrated sulphuric acid.

Depending on the mixing ratio and initial concentrations of the acid and the hydrogen peroxide, the composition of Caro's acid can vary to some extent. Relatively high levels of $H_2SO_5$ can be achieved by mixing e.g. 96%-$H_2SO_4$ and 85%-$H_2O_2$ in equimolar ratio resulting in a Caro's acid composition comprising about 49% by weight of $H_2SO_5$, about 26% by weight of $H_2SO_4$ and about 9% by weight of $H_2O_2$. However, to avoid the safety hazards attached to very high concentrations of $H_2O_2$, it may be desirable to start with e.g. equimolar amounts of 98%-$H_2SO_4$ and 50%-$H_2O_2$, which results in a Caro's acid composition comprising about 23% by weight of $H_2SO_5$, about 40% by weight of $H_2SO_4$ and about 13% by weight of $H_2O_2$.

An alternative form of Caro's acid is prepared by electrolysis of ammonium sulphate, resulting in an aqueous solution of ammonium bisulphate and peroxymonobisulphate.

In solid form it is commercially available as the triple salt $KHSO_5$:$KHSO_4$:$K_2SO_4$ in the molar ratio of about 2:1:1, and accordingly, comprises about 50% by weight of the active oxygen compound, corresponding to about 5% active oxygen by weight of the triple salt.

The amount of active oxygen which should be available in the instant compositions, ranges from 0.08 to about 1% by weight of the total composition. Accordingly, the inorganic peroxy compound is included in an amount of from 0.5 to 10% by weight of the total composition, calculated on the basis of the simple peroxy acid form. Preferably the peroxy compound is included in an amount of from 1.8 to 5.7% by weight.

Optionally, also small amounts of hydrogen peroxide may be included in addition to the inorganic peroxy compound. Suitably, hydrogen peroxide is included in an amount of from 1 to 5% by weight.

Suitable degrees of thickening will be achieved with viscosities which range from 10 to 250 mPa.s and preferably from 20 to 100 mPa.s. According to the present invention the above viscosities are obtained by way of a thickening system comprising two essential components, a thickening surfactant selected from the group of amine oxides, amines and cationic detergent actives, and a strong acid.

The amine oxides which are suitable for use in the present compositions, have the structural formula:

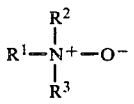

(I)

wherein $R^1$ is a $C_6$–$C_{18}$ straight or branched alkyl group preferably being a $C_{12}$–$C_{18}$ alkyl group, and $R^2$, $R^3$ are short chain alkyl groups, such as methyl, ethyl, n-propyl, iso-propyl, n-butyl, isobutyl and t-butyl. Preferably $R^1$ is a saturated alkyl group. In general $R^2$ and $R^3$ will be the same, but they can also differ if so desired. Typical amine oxides which have been found suitable for the instant compositions are products which are commercially available under the tradenames Empigen OB, OC and OH (ex Albright & Wilson, UK), Symprolam 35 DMC (ex ICI, UK,), and Aromox DMMCD-W (ex Akzo Chemie).

Suitable amines for use in the thickening system of the present invention are tertiary amines of the formula:

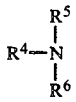

(II)

wherein $R_4$ is a $C_8$–$C_{18}$ straight or branched, preferably saturated alkyl group and $R^5$, $R^6$ are short-chain alkyl groups, such as methyl and ethyl. Typical amines which have been found suitable for the instant compositions are products which are commercially available under the trade names Armeen DM12D, DM14D, DM16D, DMCD, DMMCD, DM824 (Akzo Chemie, UK).

Suitable cationic detergent actives are non-halide quaternary ammonium salts, having one $C_8$–$C_{18}$ preferably saturated alkyl group and three short-chain $C_1$–$C_4$ alkyl groups. Preferred examples thereof are the alkyl trimethyl ammonium bisulphates, methosulphates and ethosulphates.

The concentration of the thickening surfactant lies within the range of from 0.5 to 15% by weight of the total composition, the range from 2 to 7.5% by weight being preferred.

The thickening surfactant can be the sole surfactant material, but also other surfactants can be included in combination therewith up to an amount of 5% by weight of the total composition. Suitable co-surfactant materials are of the nonionic and zwitterionic type.

Examples of such materials include the alkoxylation products of fatty alcohols, in particular the alcohol ethoxylates; betaine surfactants, in particular the sulphobetaines, such as coconut dimethyl sulphobetaine. Also anionic co-surfactants with a large amount of nonionic character may be used instead of or in admixture with the nonionic co-surfactant. Suitable examples thereof are the carboxylated and sulphated derivatives of ethoxylated fatty alcohols. Only minor amounts of conventional anionic surfactants such as linear alkylsulphates, alkylsulphonates and alkyl benzene sulphonates can be included.

When a combination of thickening surfactant/co-surfactant is used, the weight ratio between the thickening surfactant and the co-surfactant is preferably at least 1:1 and more preferably at least 3:1.

The second component which is essential in obtaining stable and long-lasting thickening is an acid, i.e. a compound capable of providing the composition with a pH value below 4. The acidic compound should be compatible with the peroxy compound. Suitable acidic compounds are in particular found among the strong mineral acids, such as nitric acid, phosphoric acid, sulphuric acid, and the partial salts thereof. Preferred are phosphoric and sulphuric acid and the partial salts thereof.

Mixtures of different acids may also be used as well as combinations of acids and the corresponding salts. Suitable such salts include the alkali metal salts of phosphoric and sulphuric acids, such as e.g. potassium biphosphate and sodium bisulphate.

The acidic compound is included in concentrations up to 50% by weight of the total composition, in particular in concentrations of from 2 to 25% by weight, the concentration range of from 4 to 20%, in particular, 5 to 20% being preferred.

It has been found that the inclusion of salts influences the physical stability and viscosity of the composition. Accordingly, stability can be advantageously controlled by careful selection of combination of acids and salts. In a preferred embodiment of the invention sulphuric or phosphoric acid is used in combination with a mixture of sulphate and/or phosphate salts, such as a triple mixture of alkali metal dihydrogen phosphate, hydrogen-sulphate and sulphate.

Such salts may suitably be included in an amount up to 30% and preferably the amount lies within the range of from 5 to 15% by weight of the total composition.

The acid or acid/salt combination should provide the compositional solutions with a pH value of below about 4, pH values of below 2.5 being preferred.

The compositions of the present invention may further include conventional additives to improve their effectiveness and/or consumer acceptability. More in particular, the compositions may contain one or more perfumes, dyes, colouring agents, corrosion inhibitors bactericides, builders, additional thickeners, hydrotropes such as octyldimethylamine oxide, opacifiers or other additives compatible with the bleach system.

Preferably, the compositions of the present invention are coloured by inclusion of coloured polymer particles as disclosed in the co-pending British patent application No. 8315838 incorporated herein by reference.

The invention will now further be illustrated by way of examples. All quantities are quoted as percentages by weight based on the total weight of the composition unless otherwise indicated.

The following ingredients were used in the formulations given in the examples:

triple salt $2KHSO_5.KHSO_4.K_2SO_4$

Caro's acid prepared by electrolysis of ammonium sulphate nominal analysis in % by weight:

$HSO_5^-$ 14.7

$NH_4^+$ 7.9

$SO_4^-$ 21.1

$H^+$ 1.4

$S_2O_8^-$ 1.2

Empigen OB ® alkyldimethylamineoxide ex Albright & Wilson alkyl composition: $C_{10}$-4%, $C_{12}$-65%, $C_{14}$-25%, $C_{16}$-6%

Empigen OC ®
alkyldimethylamine oxide ex Albright & Wilson
alkyl composition: $C_{10}$-5%, $C_{12}$-55%, $C_{14}$-23%, $C_{16}$-7%, $C_{18}$-10%

Empigen OH ®
myristyldimethylamine oxide ex Albright & Wilson

Aromox DMMCD-W ®
alkyldimethylamine oxide ex Akzo
alkyl composition: $C_{12}$-70%, $C_{14}$-29%

Synprolam 35DMO ®
$C_{13}$–$C_{15}$ alkyldimethylamine oxide ex ICI

S 3406 ®
alkyldimethylamine oxide ex Hoechst
alkyl composition: $C_{12}$-50%, $C_{14}$-20% $C_{16}$-12%, $C_{18}$-18%

Armeen DM12D ®
lauryldimethylamine ex Akzo

Armeen DM14D ®
myristyldimethylamine ex Akzo

Armeen DM16D ®
palmityldimethylamine ex Akzo

Armeen DMB50 ®
alkyldimethylamine ex Akzo
alkyl composition: $C_{12}$-40%, $C_{14}$-50%, $C_{16}$-10%

Monazoline C ®
1-hydroxymethyl-2-laurylimidazoline

Catafor CA100 ®
high molecular weight quaternary ammonium ethosulphate

Softanol 90 ®
fatty alcohol ethoxylate

Sulphobetaine DC ®
dimethyl lauryl sulphobetaine

Akypo RLMQ38 ®
laurylpolyglycolether carboxylate (2.5EO) ex Chem-Y

Akyporox OP115 ®
octylphenol ethoxylate (11–12EO) ex Chem-Y

Dobanol 25-3S ®
sulphated primary ethoxylated alcohol ex Shell Chem.GB.

Akypo RLM ®
alkylpolyglycolether carboxylic acid ex Chem-Y

GC 213 ®
perfume ex PPF International; fresh citrus pine

GC 229 ®
perfume ex PPF International; fresh fruity winter green

GC 360 ®
perfume ex PPF International; aldehydic green floral latex red 41R
coloured polymer latex method of production:

A suitable chromophore was synthesized by condensing an aminoanthraquinone with acryloyl as follows:

1,4-diaminoanthraquinone (97% pure) was dissolved in dry dimethylformamide and excess triethylamine added. The solution was cooled to 5° C. in an ice-bath and acryloyl chloride added dropwise over a period of 30 minutes, the temperature being maintained at 5° C. The solution was stirred for a further hour at 5° C., and then at room temperature for 1 hour. The reaction mixture was then recooled to 5° C. to crystallize the amine hydrochloride, which was then removed by filtration. The chromophore monomer formed in this reaction was then precipitated into cold propane-2-ol, isolated by filtration and then dried. 1.9 g of the above chromophore monomer was dissolved in 17.1 g styrene. The mixture was then emulsified in 220 g of aqueous solution containing 1.7 g sodium dodecyl sulphate as emulsifier and previously warmed to 85° C. 0.5 g of azobisisobutramidinium chloride dissolved in cooled water was added to begin the polymerisation reaction. Any unreacted styrene was removed by steam distillation, and the latex was used to produce a stable, transparent, coloured bleach.

latex blue 84.2103
coloured polymer latex

Method of production was similar to the method used for latex red 41R except that the chromophore monomer was based on Dispersal Blue 7G ® ex ICI. The amounts of the materials in the polymerisation were as follows:

0.95 g chromophore monomer
8.6 g styrene
125 g water
0.6 g sodium dodecyl sulphate
0.25 g azobisisobutramidium chloride.

The polymerisation was carried out at 80° C. for 20 hours.

| | Example 1 | | | | | | | |
|---|---|---|---|---|---|---|---|---|
| Ingredients | a | b | c | d | e | f | g | h |
| Triple salt | 7.5 | 5 | 10 | 7.5 | 9.6 | 10.7 | 3.9 | 9.4 |
| Caro's acid | — | — | — | — | — | — | — | — |
| $H_3PO_4$ | 12 | — | 12 | 4 | — | — | 12.5 | 10.4 |
| $H_2SO_4$ | — | 5 | — | 4 | 4.1 | 10 | — | — |
| $KH_2PO_4$ | — | — | 5 | — | 2.4 | — | 3.8 | — |
| Empigen OB ® | 4 | — | 3 | 2.5 | — | — | — | — |
| Empigen OC ® | — | — | — | — | 2 | — | — | 2.6 |
| Empigen OH ® | — | — | — | — | — | 1.8 | — | — |
| Synprolam 35DMO ® | — | — | — | — | — | — | 1.5 | — |
| S 3406 ® | — | 3 | — | — | — | — | — | — |
| octyldimethylamine oxide | — | — | — | — | — | 0.1 | — | 0.2 |
| latex red 41R | — | — | — | — | 0.2 | — | — | — |
| perfume GC360 ® | — | — | — | — | — | — | — | 0.2 |
| initial pH | 1.23 | 1.02 | 1 | 0.50 | — | 0.45 | 1.12 | 0.86 |
| initial viscosity (mPa.s measured at 21 sec.$^{-1}$) | 55 | 66 | 48 | 27 | — | 19 | 16 | 21 |

| | Example 2 | | | | | | |
|---|---|---|---|---|---|---|---|
| Ingredients | a | b | c | d | e | f | g |
| Triple salt | — | — | — | 10 | 7.5 | 10 | — |
| Caro's acid | 5.8 | 5 | 5.6 | — | — | — | 4.8 |
| $H_3PO_4$ | — | — | — | — | — | 20 | — |
| $H_2SO_4$ | 7.8 | 2.2 | 4.2 | 12 | 26 | — | 3.8 |
| $KH_2PO_4$ | 0.7 | 1.1 | — | — | — | — | — |
| Empigen OB ® | — | — | — | 1 | 1.2 | 0.9 | — |
| Empigen OC ® | — | — | — | — | — | — | 0.9 |
| Empigen OH ® | 1.1 | — | 2.7 | — | — | — | 0.9 |
| Synprolam 35DMO ® | — | — | — | — | — | — | — |
| S 3406 ® | — | 2 | — | — | — | — | — |
| octyldimethylamine oxide | 0.1 | — | — | — | — | — | — |
| latex red 41R | — | — | — | — | — | — | — |
| perfume GC213 ® | — | — | — | — | — | — | 0.2 |
| perfume GC229 ® | — | — | — | 0.2 | — | — | — |
| perfume GC360 ® | — | — | — | — | 0.2 | 0.2 | — |
| initial pH | 0.50 | 0.20 | 0.42 | — | — | 0.98 | — |
| initial | 47 | 22 | 192 | — | — | — | — |

-continued

| Ingredients | Example 2 a | b | c | d | e | f | g |
|---|---|---|---|---|---|---|---|
| viscosity (mPa.s measured at 21 sec.$^{-1}$) | | | | | | | |

| Ingredients | Example 3 a | b | c | d | e | f | g | h |
|---|---|---|---|---|---|---|---|---|
| Triple salt | 10 | 5 | 5 | 10 | — | — | — | — |
| Caro's acid | — | — | — | — | 5 | 2.7 | 5 | 5 |
| $H_2SO_4$ | 10 | 5 | 5 | 10 | — | 10.9 | — | 5.9 |
| $KHSO_4$ | — | — | — | — | 10 | — | — | — |
| $KH_2PO_4$ | — | — | — | — | — | — | 8.5 | — |
| Armeen DM12D ® | — | — | 0.4 | — | — | — | — | — |
| Armeen DM14D ® | — | 2 | 1 | — | 9 | 1.2 | 9 | 1 |
| Armeen DM16D ® | — | — | 1 | — | — | 1.2 | 8.3 | 1 |
| Armeen DM850 ® | 4 | — | — | — | — | — | — | — |
| $C_{12}$–$C_{14}$ alkyldimethylamine | — | — | — | — | 2 | — | — | — |
| Catafor CA100 ® | — | — | 0.6 | — | — | — | — | — |
| latex blue 842103 | — | — | — | 0.2 | — | — | — | — |
| GC213 ® | — | — | — | — | — | — | — | 0.2 |
| GC360 ® | — | — | — | — | — | 0.2 | — | — |
| initial pH | 0.51 | 0.75 | — | — | 1.31 | — | 6.1 | 0.2 |
| initial viscosity (mPa.s measured at 21 sec.$^{-1}$) | 30 | 75 | 8 | — | 11 | 220 | 18 | 158 |

| Ingredients | Example 4 a | b | c |
|---|---|---|---|
| Triple salt | 10 | 10 | 10 |
| $H_2SO_4$ | 7.3 | 4 | 8 |
| $KH_2PO_4$ | — | 3 | — |
| myristylmethyl ammoniumhydrogen sulphate | 10.1 | 5 | 4 |
| palmityltrimethyl ammoniumhydrogen sulphate | — | 2.1 | 3 |
| initial pH | 0.68 | 0.83 | — |
| initial viscosity (mPa.s measured at 21 sec.$^{-1}$) | 12 | 98 | 137 |

| Ingredients | Example 5 a | b | c | d | e | f | g |
|---|---|---|---|---|---|---|---|
| Triple salt | 10 | 10 | 10 | 10 | 10 | 10 | 5 |
| $H_2SO_4$ | 4 | 2 | 8 | — | — | 6 | — |
| $H_3PO_4$ | — | — | — | 6 | 4 | — | 6 |
| S 3406 ® | 3 | 4 | 4 | 3 | 3 | 3 | 3 |
| $H_2O_2$ | 3 | 2 | 4 | — | — | — | — |
| initial pH | 0.4 | 0.8 | 0.1 | 1.3 | 1.4 | 0.3 | 1.2 |
| initial viscosity (mPa.s measured at 21 sec.$^{-1}$) | 50 | 101 | 70 | 165 | 178 | 105 | 65 |

-continued

| Ingredients | | | | | | | |
|---|---|---|---|---|---|---|---|
| Triple salt | 10 | 5 | 10 | 5 | 10 | 5 | 10 |
| $H_2SO_4$ | 8 | — | 6 | — | 6 | — | 6 |
| $K_3PO_4$ | — | 6 | — | 6 | — | 6 | — |
| S 3406 ® | 3 | 3 | 3 | 3 | 3 | 3 | 3 |
| Dobanol 25-3S ® | 0.27<br>0.17 | — | — | — | — | — | |
| sodium dodecyl sulphonate | — | — | 0.1 | 0.1 | — | — | — |
| Akypo RLM 100 ® | — | — | — | — | 0.5 | — | — |
| sodium dodecyl benzene sulphonate | — | — | — | — | — | 0.2 | — |
| sodium sec. alkyl sulphonate | — | — | — | — | — | — | 0.15 |
| initial pH | 0.3 | 1.2 | 0.2 | 1.3 | 0.2 | 1.25<br>0.2 | |
| initial viscosity (mPa.s measured at 21 sec.$^{-1}$) | 76 | 80 | 103 | 113 | 76 | 99 | 112 |

We claim:

1. Aqueous stable thickened low-pH bleaching composition, consisting essentially of:

(a) 0.5 to 15% by weight of a thickening surfactant selected from the group consisting of:

(i) amine oxides having the structural formula

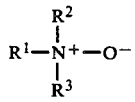

(I)

wherein $R^1$ is a $C_6$–$C_{18}$ staight or branched alkyl group and $R^2R^3$ are short chain alkyl groups being the same or different from one another;

(ii) amines having the structural formula

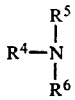

(II)

wherein $R^4$ is a $C_8$–$C_{18}$ straight or branched chain alkyl group and $R^5R^3$ are short-chain alkyl groups being the same or different from one another;

(iii) cationic detergent actives having at least one $C_8$–$C_{18}$ alkyl group with the remaining groups attached to the nitrogen being short-chain $C_1$–$C_4$ alkyl groups; and mixtures thereof, (b) 0.5 to 10% by weight of a cold-water soluble inorganic peroxy compound selected from the group consisting of peroxymonophosphoric acid, peroxydiphosphoric acid, peroxymonosulphuric acid, peroxydisulphuric acid and the alkali metal and ammonium salts thereof;

(c) up to 50% by weight of a strong acid, selected from the group consisting of nitric acid, phosphoric acid, sulphuric acid and the partial salts thereof; and (d) 0 to 30% by weight of a bleach-compatible electrolyte salt;

wherein said composition has a pH of below about 2.5.

2. A composition according to claim 1, wherein the peroxy compound is peroxymonosulphuric acid or an alkali metal or ammonium salt thereof.

3. A composition according to claim 1, wherein the thickening surfactant is a mono($C_{12}$–$C_{18}$)alkyl di($C_1$–$C_4$)alkylamine-oxide.

4. A composition according to claim 1, wherein the thickening surfactant is a mono($C_8$–$C_{18}$)alkyl di($C_1$–$C_2$-)alkylamine.

5. A composition according to claim 1, wherein the thickening surfactant is a mono($C_8$–$C_{18}$)alkyl di($C_1$–$C_4$)alkyl ammonium bi-, metho- or ethosulphate.

6. A composition according to claim 1, which further compries up to 5% by weight of a co-surfactant of the nonionic and zwitterionic type.

7. A composition according to claim 6, wherein the weight ratio between the thickening surfactant and the co-surfactant is at least 1:1.

8. A composition according to claim 1, which further comprises from 5 to 15% by weight of sulphuric and/or phosphoric acid salts.

9. A composition according to claim 1 further comprising from 1 to 5% hydrogen peroxide but said hydrogen peroxide being present at a level less than that of said inorganic peroxy compound.

* * * * *